United States Patent [19]

Dike, Jr.

[11] Patent Number: 4,763,547

[45] Date of Patent: Aug. 16, 1988

[54] SHINGLE REMOVING APPARATUS

[75] Inventor: John H. Dike, Jr., Stoneham, Mass.

[73] Assignee: Dike Equipment Co., Stoneham, Mass.

[21] Appl. No.: 76,130

[22] Filed: Jul. 21, 1987

[51] Int. Cl.[4] ..... B25B 33/00

[52] U.S. Cl. ..... 81/45; 30/169

[58] Field of Search ..... 81/45, 46, 44; 30/167, 30/167.1, 167.2, 269, 270, 271; 254/26 A, 131.5

[56] References Cited

U.S. PATENT DOCUMENTS

| | | | |
|---|---|---|---|
| 1,535,211 | 4/1925 | Hansen | 297/37 |
| 4,091,535 | 5/1978 | Lehrter | 30/169 |
| 4,277,104 | 7/1981 | Sanchez | 30/169 |
| 4,663,995 | 5/1987 | Amundson | 254/131.5 |
| 4,691,439 | 9/1987 | Marra | 299/36 |

*Primary Examiner*—Frederick R. Schmidt
*Assistant Examiner*—Blynn Shideler
*Attorney, Agent, or Firm*—Lahive & Cockfield

[57] ABSTRACT

A shingle stripping tool featuring a frame with a power-head attached to the lower end of the frame with a handle attached to the upper end of the frame. The power head includes a fulcrum which is integral with the frame and a lift plate mounted for articulating movement about a pivot axis located on the frame. A pneumatically powered drive pivots the lift plate. The pneumatic drive is activated by a switch.

11 Claims, 4 Drawing Sheets

14
10
20
100
A
B
C

SHINGLE REMOVING APPARATUS

BACKGROUND OF THE INVENTION

This invention relates to a shingle removing apparatus. More particularly, it relates to powered devices for removing overlapping shingles from the roof or sides of buildings.

The exterior surfaces of buildings often are covered with a plurality of overlapping, horizontally aligned rows of shingles. The first row is generally laid across the lower most edge of the surface to be covered and nailed or stapled in place at the upper portion of the shingle. Each successive row is secured to the roof with the lower portion overlapping the immediately preceding lower row to cover the attaching fasteners. In some roofing, the overlapping portion is also secured to the bottom shingle by heat sensitive adhesive. Some building surfaces are covered with roll roofing, in which successive sheets of roofing material are overlapped in a similar manner.

Shingles deteriorate with age and are otherwise prone to damage and wear necessitating periodic removal and replacement. To remove the shingles, it is necessary to pry the shingles and fasteners upwardly. This can be difficult as the shingles lie flat and are held with a plurality of nails securing them to the subsurface, and are often adhered to one another. During removal the shingles often split or rip, littering the shingled surface with debris which must be removed before a new protective surface can be applied. Numerous tools have been developed for stripping shingles from roofs and the like, however, these tools have various drawbacks. Therefore, the removal of shingles remains a laborious, potentially dangerous, and time consuming job.

Many of the prior art devices comprise a type of crowbar having a claw on one end which is forced in beneath the covering shingle so as to engage a nail which holds down the shingle to be removed. The bar may be provided with some type of leveraging mechanism for aiding manual prying up of the shingles and the nails. For example, U.S. Pat. No. 4,009,743 discloses a manual an elongated handle with a flat lower edge adapted to be forced beneath a shingle. The outer most edge engages the nail and a rocking action assists in the removal of the nails and shingles. U.S. Pat. No. 3,769,644 discloses a roofer's hammer having a specialized claw at the opposite end of the hammer head. The curved claw is slipped under shingles until it engages the nail, and the head of the hammer is forced downward. U.S. Pat. No. 3,987,827 discloses a shingle removing tool having a forward facing claw and a rear facing notch while the other free end portion constitutes a handle.

Other shingle removing devices known in the art are power driven. For instance, U.S. Pat. No. 4,277,104 describes a device having a powered reciprocating plate with a notched forward edge that moves in a concave arc during the reciprocating movement. U.S. Pat. No. 2,722,072 discloses a power operated hand tool for scrapping and feathering the surfaces of metal sheets. U.S. Pat. No. 3,779,605 discloses a roofing removal tractor having slideable guide rods carrying a cutting head.

Though several shingle removing devices are known in the art, these tools do not enable shingle stripping operations to be performed in as rapid and efficient manner as may be desired. Furthermore, there has been an inability to efficiently remove stripped material out of the way so as to provide a clear path for the forward movement of the stripping machine. Stripped material which accumulates immediately in front of the stripping machine impedes progress of the operation. Other drawbacks include sharp blades which shear off nail heads. The remaining nail shaft is difficult to remove from the subroof. If such cut nails are allowed to remain in the subroof, they may damage subsequently applied new roofing. Another drawback in many of the known devices is the angle of the tool handle and blade. The force vector in the forward or stripping motion loses significant force to the downward vector, and this results in excessive force being utilized by the tool operator making the work much harder than it need be. In many instances, the applied downward force results in damage to the subroof, or injury to the workman.

Accordingly, as shingle removal is a difficult, tiring, and dangerous task, a need exists for a roof shingle removing tool which will enable a roofer to remove roofing shingles in a more efficient, safer and less tiring manner. It would be desirable to provide a powered machine which operates to strip away old shingles leaving exposed the basic structure of the surface generally prepared to receive a new layer of shingles.

Accordingly, it is an object of the invention to provide a shingle removing device which can efficiently and rapidly remove roofing shingles from building roofs and sides. Another object is to provide an apparatus that may be employed with a minimal amount of expended energy by the user. It is another object to provide a shingle removing device which allows the shingles and nails to be lifted simultaneously. Other objects are to provide a shingle removing device that may be easily and safely handled by a single operator even when employed on a sloped roof of a building; to provide a sturdy, simple, light weight, easily constructed apparatus; and to provide a machine which is portable and may be powered by conventional methods thereby enabling the machine to be used in numerous environments. These together with other objects and advantages which will become apparent subsequently reside in the details of construction and operation as more fully hereinafter described and claimed.

SUMMARY OF THE INVENTION

A device has now been developed for stripping fastened shingles or roll roofing (hereinafter collectively "shingles") from a surface which is both easy to use by one workman, portable, and efficient. The tool alleviates the tedious, precarious, and labor intensive process typically encountered in removing shingles. It is a power driven machine for use by a single operator. The operator guides the leading end of the device under a shingle, which, along with its associated fasteners, are lifted up and out of the way by articulating movement of a power driven lift plate.

The invention features an apparatus comprising a frame member having a power head attached to the lower end of the frame member. A handle is attached to upper end distal to the power head. The power head includes a fulcrum which is integral with the frame member and a lift plate mounted for articulating movement about an axis on a pivot connected to the frame member. A drive means is connected to the lift plate to power its articulating movement. A switch is provided for actuating the drive means.

In one embodiment, the fulcrum is a finger fixed to the lower end of frame member and extending perpendicular to the axis of articulation of the lift plate. The finger may be narrower than the lift plate and may have a tapered, distal end. The finger extends less than the length of the lift plate, most preferably one-half the length of the lift plate, and preferably rests within an interfitting opening in the lift plate when the plate is disposed in its lower position.

In another embodiment, the fulcrum comprises a lift plate support frame which extends perpendicular to the axis of articulation of the lift plate. The support frame may extend the full length of the lift plate and provide support for all surfaces of the lift plate when the plate is in the lower position.

The drive means preferably comprises a piston mounted on the frame member or preferably between the lift plate on the support frame. In preferred embodiments, the piston is driven hydraulically or pneumatically, though other power means may be suitable. The hydraulically or pneumatically powered apparatus includes means for receiving pressurized hydraulic liquid or compressed air, respectively, which is operatively connected to the pressurized-fluid driven piston. Switch means controls the flow of fluid power. The switch means may comprise means for cycling pressurized liquid or compressed air to the piston so that the lift plate is powered to intermittently articulate about the pivot. Alternatively, the switch means may comprise a manually operable switch disposed adjacent the handle which controls the flow of fluid power to the piston.

The frame member may comprise an elongate shaft. In another embodiment, the frame member comprises a compact housing body with a piston or other drive means mounted therein.

In preferred embodiments, the lift plate comprises a blade having a series of grooves on its leading edge for engaging nails. The lift plate may be equipped with a deflector surface which extends upwardly and backwardly to clear lifted shingles out of the way.

The features of the invention allow a workman to force the lift plate beneath the shingle into engagement with a shingle fastener when the plate is in a first, downwardly disposed insertion position. When the switch is actuated, the lift plate articulates upwardly, powered by the drive means, to a lift position and lifts the shingle and the nail up, pulling the nail from the roof board. The lift plate is then returned to its downwardly disposed insertion position and the device is advanced to the next shingle while the previously removed shingle and nail curl up around the deflection plate and are discarded. The features of the invention enable efficient and rapid removal of shingles. The fulcrum provides leverage for the lifting operation, thereby relieving stress on the user. The device can be used with one hand and more than doubles the speed at which a workman can strip a roof.

DESCRIPTION

Figure 1:
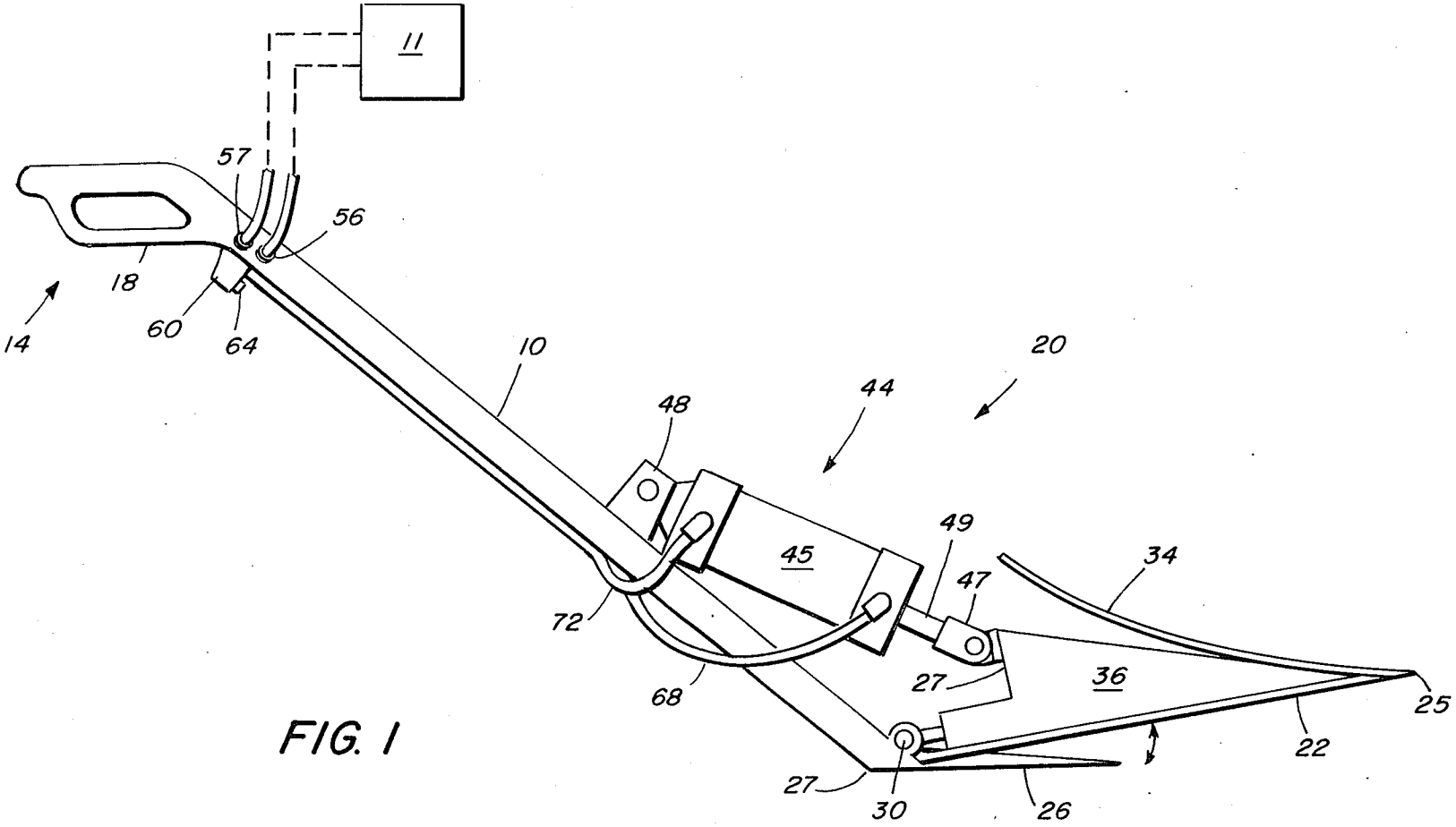
FIG. 1 is a schematic side view of a first embodiment of the invention.
Figure 2:
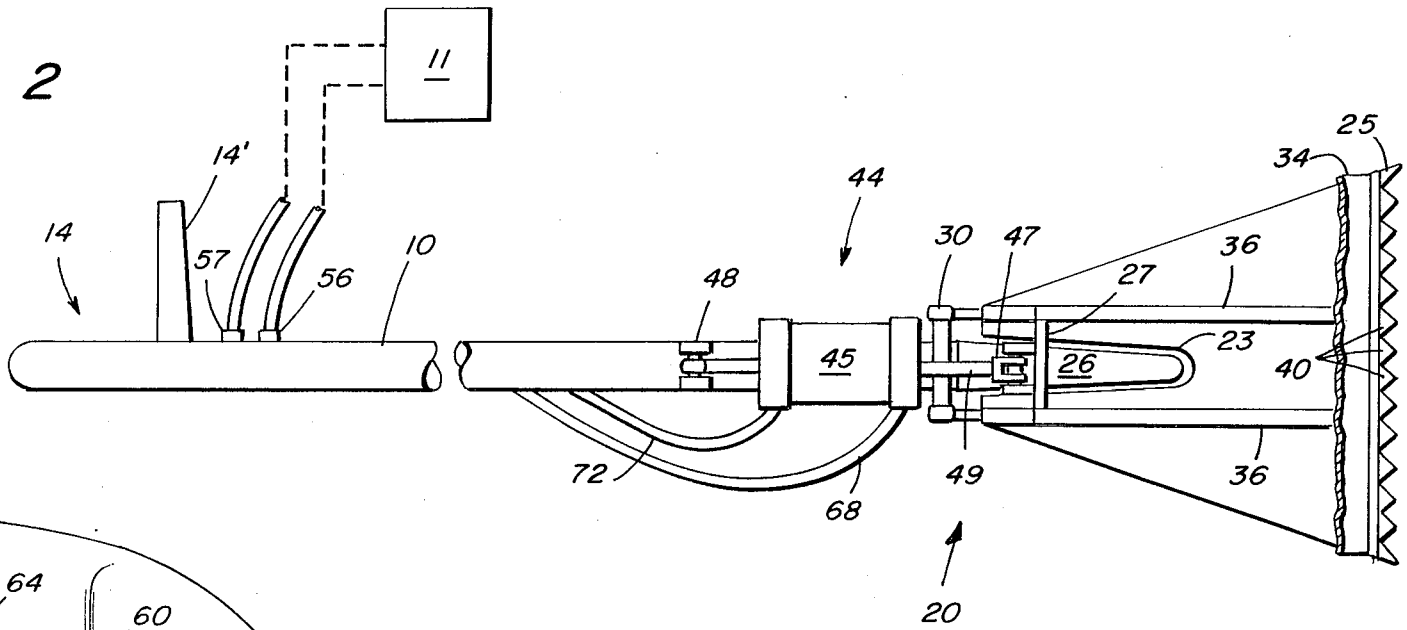
FIG. 2 is a top plan view, partly broken away, of the embodiment of FIG. 1.

Referring to the drawing, FIGS. 1 and 2 depict one embodiment of the shingle removing device of the present invention. A frame member 10 in the form of a shaft is fitted with a handle 14 for gripping and guiding the device. The handle may include a gripping shaft 14' disposed perpendicular to the shaft 10. The placement and design of the handle 14 and shaft 14' provide for leverage and balance. A hand guard 18 protects the operator's hand against contact with shingles. The frame member 10 is preferably of light weight metal.

The opposite end or working end of the frame member 10 is fitted with a power head 20. The power head 20 comprises a hydraulically, pneumatically or otherwise powered articulating flat lift plate 22 and a fulcrum. In the illustrated embodiment, the fulcrum takes the form of a finger 26, which extends perpendicular to the axis of articulating movement of the lift plate 22. It is preferred that the finger 26 comprise a narrow structure as compared with the lift plate 22 and extend a shorter distance than the lift plate, preferable about one-half the length of the lift plate 22 as illustrated. It is also preferred that the lift plate define a central opening 23 extending perpendicular to the axis of the articulating movement whereby the finger 26 interfits with the opening 23 upon downward movement of the lift plate 22. In other embodiments, finger 26, attached rigidly to shaft 10, may be omitted, and point 27 may act as a fulcrum. Finger member 26 is preferred as it relieves stress on shaft 10 and on the user.

The rear end of the lift plate 22 is attached to the frame member 10 at pivot 30, allowing for articulating movement of the lift plate 22 between a first lowered insertion position and a second, raised, shingle lift position as indicated by the arrows in FIG. 1. The pivot 30 may comprise a hinge or similar device. The lift plate 22 and finger 26 preferably comprise durable metal such as carbon steel. The lift plate 22 is fitted at its leading edge with a blade 25 provided with a transverse series of grooves 40 in the shape of a "V", though other shapes may be suitable. These grooves 40 are designed to engage the shanks of the roofing nails. The lift plate may be wide enough to enable a number of nails to be engaged simultaneously. The blade 25 may be fixed to lift plate 22 in a known manner to facilitate its replacement.

Fixed to lift plate 22 is an arcuate deflector plate 34 which extends rearwardly and upwardly from the top surface of lift plate 22. A pair of gusset members 36, secured to the top surface of lift plate 22, support the deflector plate 34 along its underside, serve to reinforce the lift plate against bending, and serve to secure a clevis mounting plate 27 integral with the lift plate.

The power head 20 also includes a powered drive means 44 mounted on the upper surface of the frame member 10. In this embodiment, the drive means 44 comprises a piston 45 which attaches at its upper end to the frame member 10 by attachment means 48 such as a clevice or other device. The lower end of the piston 45 is attached to a clevis 47 fixed to clevis mounting plate 27. The attachment means 48 and 47 allow for reciprocating movement of the piston to power the articulating movement of the lift plate 22.

The piston 45 is powered by hydraulic, or preferably, pneumatic pressure, delivered through lines 68, 72, a switch 60, and couplings 56 and 57 mounted on shaft 10 for attachment to lines 58 and 59 which communicate with a source of hydraulic or pneumatic power, e.g., a pump or compressor. The switch 60 is manually actuated by a trigger 64 adjacent handle 14 for selectively controlling the supply of power to the piston 45. In hydraulically or pneumatically powered embodiments, the switch when depressed permits delivery of pneumatic pressure through line 68, forcing the piston and its associated drive shaft 49 rearwardly, and powering upward movement of lift plate 22 about pivot 30. Releasing the trigger 64 powers the piston 45 in a forward direction to force lift plate 22 downwardly. Other known means and modes of operating the piston may be used. For example, when the device is designed as preferred to exploit pneumatic power, a spring may be used to return piston 45 to the downward position in conjunction with a bleeder valve to release air trapped below the piston. Alternatively, the switch 60 on shaft 10 can be omitted, and a source of cyclic pneumatic or hydraulic power 11 used in its place. Such sources would at regular intervals supply power through couplings 56, 57, and lines 68 and 72 to periodically raise and lower lift plate 22 about pivot 30. Such power sources are known per se, and contain known mechanisms which in this case act as a switch means.

Those skilled in the art will appreciate that other types of drive means may be substituted for piston 45. For example, an electric motor, suitably geared, could be mounted on shaft 10 to power upward movement of lift plate 22 and return it to the lower insertion position. Alternatively, a linear internal combustion engine which delivers linearly directed power could be used. The piston is preferred as it adds relatively little weight to the device, and can be powered by a remote power source located, e.g., on the ground. It is contemplated that the power source may be a compressor of the type currently used with pneumatic nailing guns.

Figure 3:
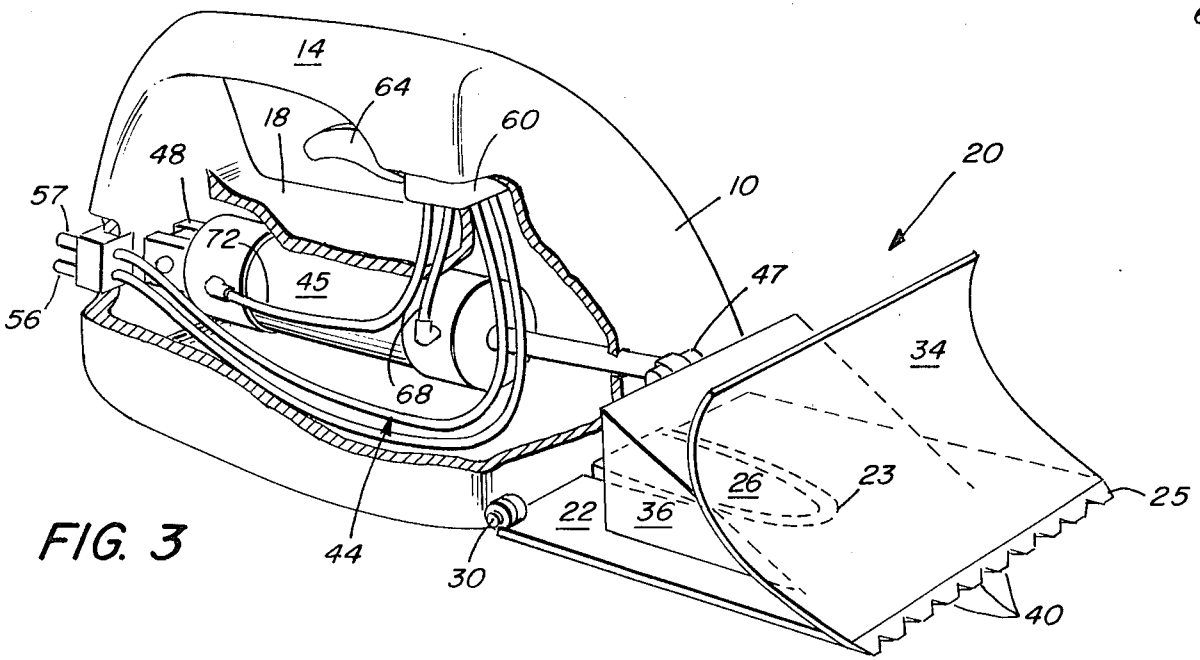
FIG. 3 is a perspective, partly cut-away second embodiment of the invention.

FIG. 3 illustrates another embodiment of the shingle removing device of the present invention, wherein like reference characters indicate parts corresponding to the embodiment of FIGS. 1 and 2. FIG. 3 depicts a more compact, hand-held shingle removing device which can be used by the operator in a seated or kneeling position. The frame member 10 comprises a compact hollow housing body provided with a handle 14 and a power head 20.

The placement of the handle 14 and configuration of the frame member 10 provide for leverage and facilitate use with one hand and in a seated or kneeling position. The shape of the frame member also defines a hand guard 18 which protects the operator's hand from contact with the roof surface. The frame member is preferably of lightweight material making the device easy and safe to operate.

The power head 20 includes drive means 44 which is mounted within the housing body. The drive means 44 in this embodiment preferably comprises a piston 45 attached at its upper end within the housing body by attachment means such as a clevice 48 or a similar device. The lower end of the piston 45 is attached to the upper surface of the lift plate 22 by attachment means 47 such as a clevice or other suitable device. The attachment means enables the the drive means to move into and out of position within the housing body in reciprocation with the articulating movement of the lift plate.

Power receiving couplings 56, 57 are located preferably at the back of the frame member 10. A switch means 60 is operatively connected to the power receiving means and is actuated by a trigger 64 on the underside of the handle 14 for selectively controlling the supply of power to the piston 45.

The use of a finger 26 or some other means to relive stress on the arm of the user and on housing 10 is preferred in this embodiment, as it omits an elongate shaft such as is shown at 10 in FIGS. 1 and 2. The shaft provides a leverage advantage to the user of the device of FIGS. 1 and 2 if finger 26 is omitted and fulcrum point 27 is used. However, because of the relatively short longitudinal dimension of the device of FIG. 3, little leverage is gained, and thus the finger 26 becomes a more important element of the apparatus.

Figure 6:
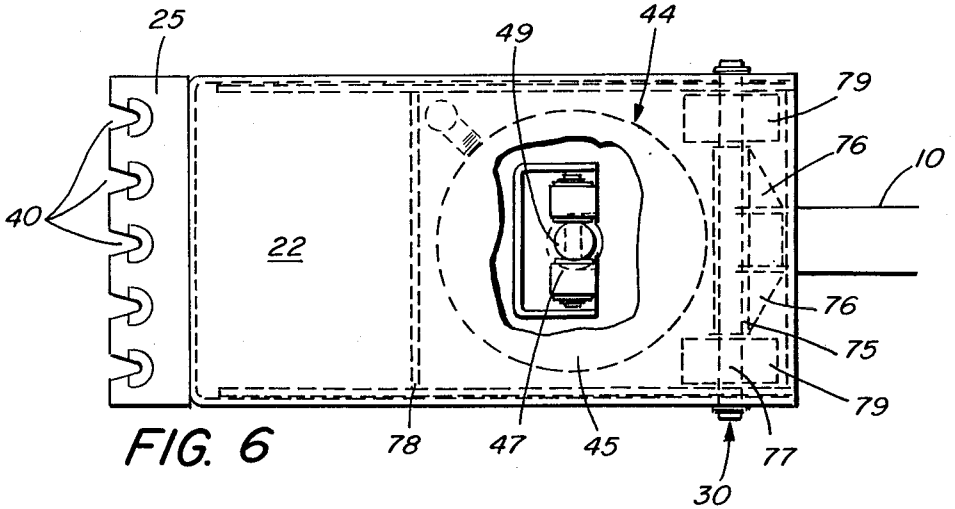
FIG. 6 is a top plan view of the embodiment of FIG. 5 with some parts shown in phantom for clarity.
Figure 5:
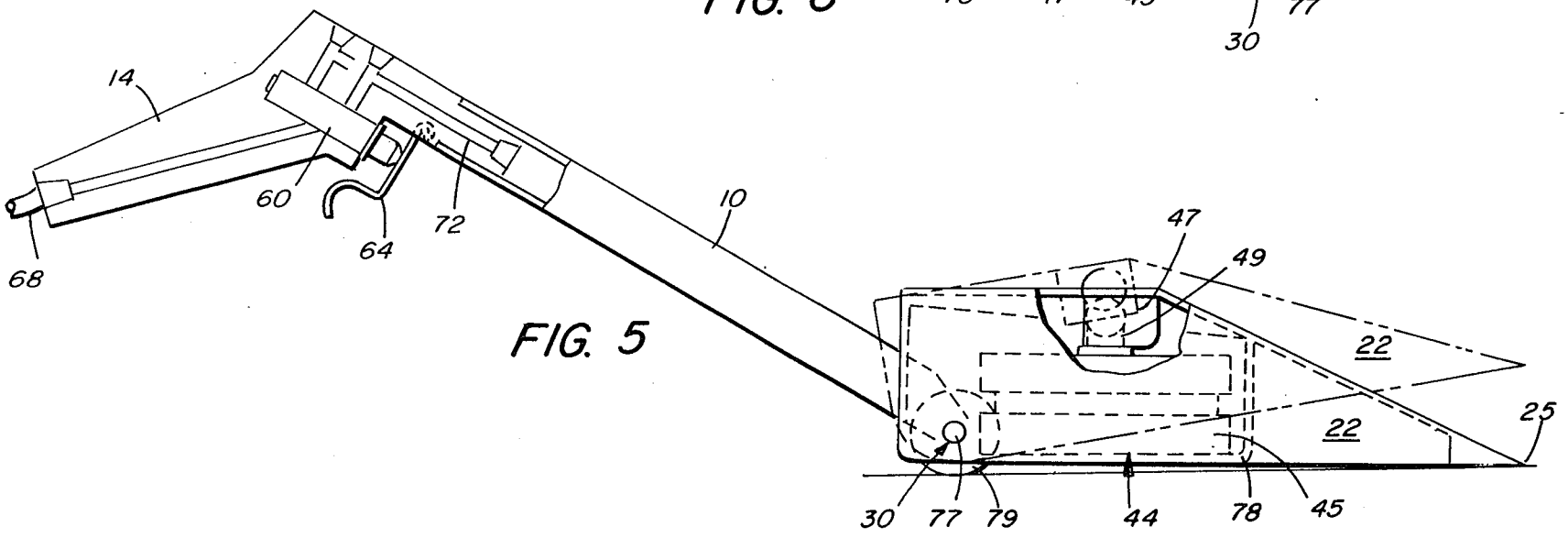
FIG. 5 is a schematic side view of the currently preferred embodiment of the invention showing the lift position of the lift plate in phantom; and a cut away view of the handle region.

FIGS. 5 and 6 illustrate a currently preferred embodiment of the shingle removing device of the present invention, wherein like reference characters indicate parts corresponding to the embodiment of FIGS. 1 and 2.

Fitted on the opposite end of frame member 10, from handle 14, switch 60 and trigger 64 is an axle 77 disposed perpendicular to the elongate metal tube frame member 10. Triangular supports 76 receive frame member 10. The axle 77 pivots about pivot point 30, and carries a pair of laterally disposed support sheets 79, a lift plate frame support structure 78 which acts as a fulcrum, and a lift plate 22.

Fitted to lift plate 22 is a blade 25 which contains a traverse series of grooves 40. As seen in FIG. 5, the lift plate 22 extends rearwardly and tapers upwardly from blade 25 to a height sufficient to house a pneumatic drive means 44. The drive means 44 is mounted on the upper surface of lift plate frame support 78 and housed within the lateral walls of lift plate 22. Drive means 44 comprises a piston 45 having a drive shaft 49 attaches to a clevis 47 fixed to an upper portion of the structure of lift plate 22. The reciprocating movement of the piston shaft 49 acts to power the articulating movement of lift plate 22.

The piston 45 is powered by pneumatic pressure delivered through line 68, switch 60, and internal conduit 72. The switch, when depressed, allows delivery of pressure through line 72, forcing the drive shaft 49 upwardly, powering the upward movement of lift plate 22 about pivot 30. Releasing trigger 64 returns the shaft (by means of a spring, not shown, incorporated in the piston's structure) to the downward position.

Exemplary operation of the novel shingle removing device is illustrated in FIGS. 4A through 4D. This illustrated use involves the apparatus of FIGS. 1 and 2 used on a sloped roof. The operation is fundamentally the same as applied to shingle siding on a vertical exterior wall or using the device of FIGS. 3 or 5 and 6.

Figures 4A, 4B, 4C, 4D:
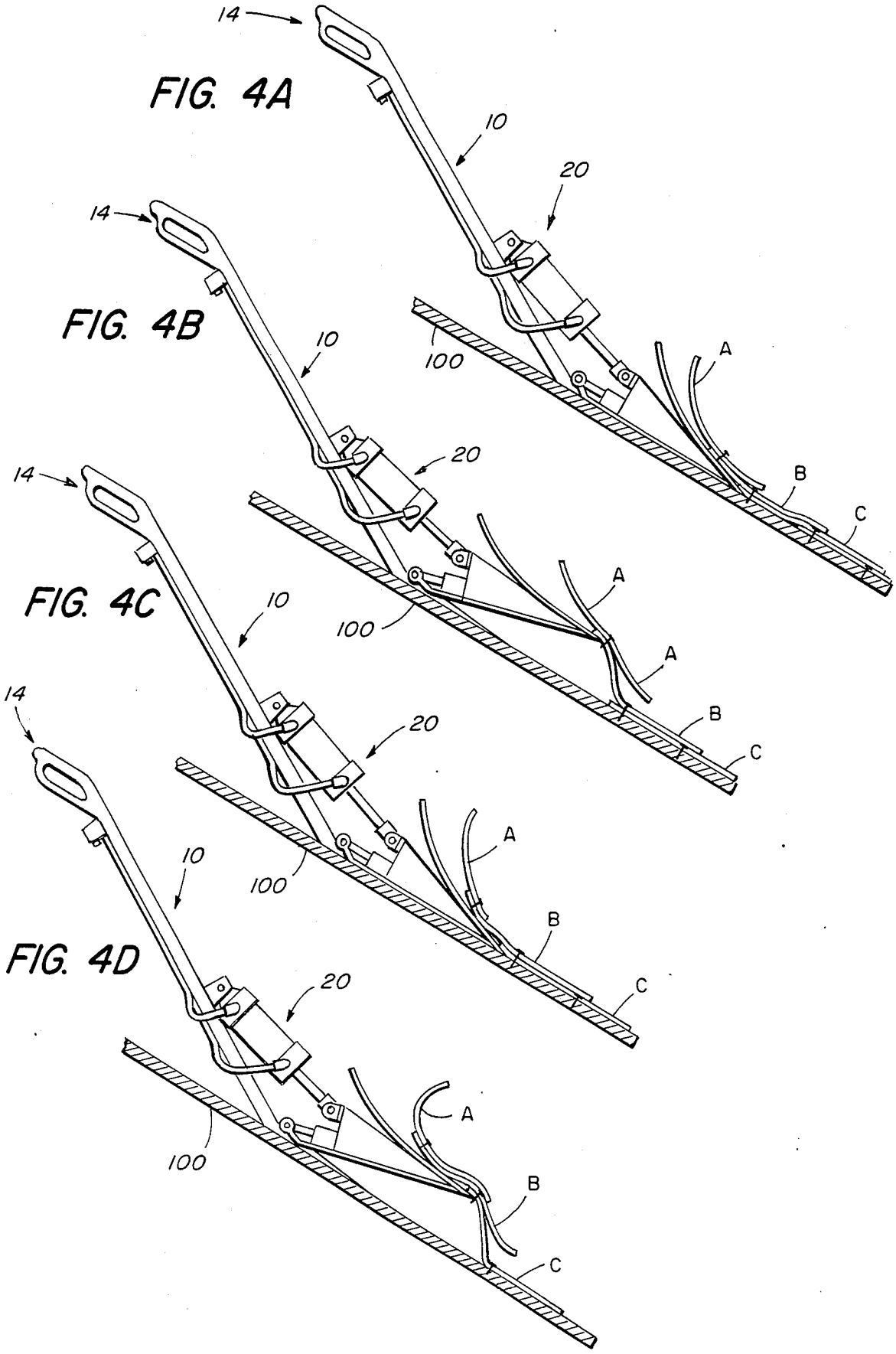
FIG. 4A–4D are schematic diagrams illustrating a method of use of the apparatus of the invention.

In operation, the operator sits or stands on roof section 100 and grips the handle 14. The angular relation of the handle and lift plate relative to the body enables the device to be used with one hand and in a comfortable position. With the lift plate 22 resting atop the roof 100 and coplanar with the finger member 26 (or lift plate frame support 78 were the device of FIGS. 5 and 6 depicted) in its first, insertion position, the operator advances the leading edge of the lift plate to insert it beneath the edge of the shingle A until a nail is encountered. (FIG. 4A) The switch 60 is actuated to transmit power through couplings and lines to the piston 45 to effect the lifting motion of the lift plate 22. The piston thereby powers the lift plate upwardly to its second, shingle lift position (FIG. 4B). The finger 26 acts as a fulcrum as the lift plate 22 is thrusted upwardly. The shingle and the nail are thereby moved upwardly, pulling the nail from the roof subsurface. Release of the trigger moves the lift plate downwardly, returning it to the insertion position. The operator proceeds forward to force lift plate 22 to a position beneath the next shingle B while the previously removed shingle and nail curl up around deflector plate 34 and are discarded.

The operator can proceed rapidly and safely as there is no need to exert any strength or body movement to extract the shingles. The present invention can remove both roofing material and its securing nails or other fasteners in a single operation. The deflector plate diverts the detached shingle in a path out of the way of the operator, the roof surface, and the device. This prevents stripped material from accumulating in front of the machine and blocking its progress. The narrowness of the finger 26 and its pointed end cooperate with the lift plate 22 to assure that shingle debris, nails and the like do not get caught between the finger and the lift blade. The finger 26 lodged within the recess 23 also facilitates movement of the apparatus despite edges of roof boards that may be encountered, and provides a fulcrum for the lifting operation thereby relieving stress on the user. In the embodiment of FIGS. 5 and 6, shingle debris is prevented from fouling the piston by the front upper surface of the lift plate 22, which serves as a deflector surface. The device can be used with one hand, and significantly decreases the manpower needed to strip a roof prior to reshingling. Many roofers already own pneumatic nailing guns, and the same source of power can be used for both tools.

The weight and configuration of the embodiment of FIG. 1 allows the operator to grip the handle 14 at one end, leaving one arm free if the operator at any point in time needs to balance himself.

The tool includes elements which in cooperation release shingles and nails effectively without creating unnecessary unbalanced forces on the roofer. This device is operated easily and safely while working from a nearly erect, or sitting position whether the shingles are to be stripped starting from the top of the roof, the eaves, or side-to-side.

The shingle removing device is particularly suited for removing shingles from an inclined roof, although it may also be used for stripping other covering materials including roll roofing fastened to various types of surfaces.

The invention may be embodied in other specific forms without departing from the spirit and scope thereof. Accordingly, other embodiments are within the following claims.

What is claimed is:

1. Apparatus for stripping fastened shingles comprising:

a frame member;

a power head attached to one end of said frame member;

a hand grip on the frame member distal to said power head;

said power head comprising:

(a) a lift plate mounted for articulating movement about an axis on a pivot connected to said frame member;

(b) a support structure connected to said frame member, disposed below said lift plate, and having a top mounting surface;

(c) pneumatically powered drive means mounted on said mounting surface on said support structure beneath said lift plate and having a drive shaft operative to be pneumatically powered substantially normal to and away from said mounting surface to force said lift plate about said axis away from said mounting surface and to return toward said mounting surface upon release of pneumatic power to permit said lift plate to pivot about said axis back toward said mounting surface;

means for receiving remotely generated pneumatic power deliverable to said drive means for powering said drive shaft away from said mounting surface; and switch means for actuating delivery of and for releasing pneumatic power delivered to said drive means.

2. The apparatus of claim 1 wherein said frame member comprises an elongate shaft and said switch means is mounted adjacent said hand grip.

3. The apparatus of claim 1 wherein said support structure is mounted for articulating movement coaxially with said lift plate.

4. The apparatus of claim 1 wherein said pneumatically power drive means comprises a pneumatic piston integral with said drive shaft and a bleeder valve to release fluid trapped below said piston.

5. The apparatus of claim 4 wherein said piston further comprises a spring for returning said piston and said drive shaft to a downward position.

6. The apparatus of claim 1 wherein said support structure includes lateral walls surrounding said drive means.

7. The apparatus of claim 1 wherein said lift plate comprises a means for connection with said drive shaft.

8. The apparatus of claim 1 comprising a single pneumatic power line housed within said frame member and extending from said switch means to said drive means.

9. The apparatus of claim 1 wherein said lift plate comprises a blade having a series of grooves on a leading edge of said lift plate to facilitate removal of fasteners holding said fastened shingles in place.

10. The apparatus of claim 9 wherein said lift plate comprises a deflection surface extending rearwardly and upwardly from the leading edge of said lift plate.

11. The apparatus of claim 1 wherein said frame member comprises an elongate shaft.

* * * * *